United States Patent [19]

Atkinson

[11] 3,986,565

[45] Oct. 19, 1976

[54] EXHAUST MEANS FOR PERCUSSION TOOL MOTORS

[75] Inventor: Gerald O. Atkinson, Pasadena, Tex.

[73] Assignee: Hughes Tool Company, Houston, Tex.

[22] Filed: Dec. 26, 1974

[21] Appl. No.: 536,529

Related U.S. Application Data

[63] Continuation of Ser. No. 373,229, June 25, 1973, abandoned.

[52] U.S. Cl. ..... 173/15; 85/8.8; 173/73; 173/78; 173/80; 173/132

[51] Int. Cl.[2] ..... E21B 21/00; F21B 1/00

[58] Field of Search ..... 173/17, 66–70, 173/73, 78, 80, 132, 15; 64/23; 403/326, 377; 285/298, 302; 85/8.8

[56] References Cited

UNITED STATES PATENTS

| | | | |
|---|---|---|---|
| 626,762 | 6/1899 | Leyner | 173/78 |
| 2,210,811 | 8/1940 | Kelpsch | 297/DIG. 7 |
| 2,800,884 | 7/1957 | Movi | 173/132 |
| 2,925,802 | 2/1960 | White, Jr. | 85/8.8 UX |
| 3,164,214 | 1/1965 | Oelke | 173/73 |
| 3,198,264 | 8/1965 | Oelke et al. | 173/78 X |
| 3,599,730 | 8/1971 | Luthman et al. | 173/17 |

*Primary Examiner*—Ernest R. Purser
*Assistant Examiner*—William F. Pate, III
*Attorney, Agent, or Firm*—Robert A. Felsman

[57] ABSTRACT

Following is disclosed an improved split-type stop ring having two separable body portions forming an annular composite body with passage means useful with a fluid operated, percussion type drill motor for retaining a drill bit and enabling the by-pass of fluid when the bit is suspended above the bottom of a borehole. Fluid by-pass enables the continued flow of fluid to clean the borehole bottom while stopping the otherwise damaging piston-hammer reciprocation when the bit is suspended above bottom.

1 Claim, 3 Drawing Figures

EXHAUST MEANS FOR PERCUSSION TOOL MOTORS

This is a continuation of application Ser. No. 373,229 filed June 25, 1973 now abandoned.

BACKGROUND OF THE INVENTION

1. Field of the Invention

This invention relates in general to fluid operated, percussion type drill apparatus and in particular to improved means for enabling the by-pass of fluid to cause cessation of piston-hammer reciprocation when the drill bit is suspended above the bottom of a borehole.

2. Description of the Prior Art

It has long been apparent that it is advantageous in percussion drilling to cease piston-hammer reciprocation and hammering on the associated anvil bit when the bit is suspended above the borehole bottom. This reduces the frequency of fatigue failure. In addition, it is advantageous to continue to exhaust fluid to the borehole bottom for removing cuttings that may otherwise accumulate when drilling ceases. These objectives have been accomplished in the prior art through the provision of various passages that enable fluid flowing through the motor to exhaust to atmosphere rather than drive the piston-hammer. One such arrangement is shown in U.S. Pat. No. 3,311,177. Another is shown in U.S. Pat. No. 3,595,323. Yet another is shown in U.S. Pat. No. 3,136,375. In these prior art devices, the exhausting passages are formed in the anvil bit itself, or in the motor housing or chuck means. Such arrangements require additional machining operations, add to manufacturing costs, and weaken the associated components.

SUMMARY OF THE INVENTION

One of the objects of this invention is to provide an improved split-type stop ring that serves the dual function of retaining the anvil bit within the associated housing and simultaneously providing passages that enable fluid by-pass when the bit is suspended above a borehole bottom. The use of such a ring eliminates the necessity for forming additional grooves or passages in either the anvil bit or the housing. In general this object is accomplished in the improved split-type stop ring by using two separable body portions which together form an annular composite body, with fluid passage means formed in at least one of the bodies to permit the by-pass of fluid past the ring and between the anvil bit and the housing. Additional features, objects and advantages of the invention will become apparent in the following description of the preferred embodiment.

DESCRIPTION OF THE PREFERRED EMBODIMENT

Figure 1:
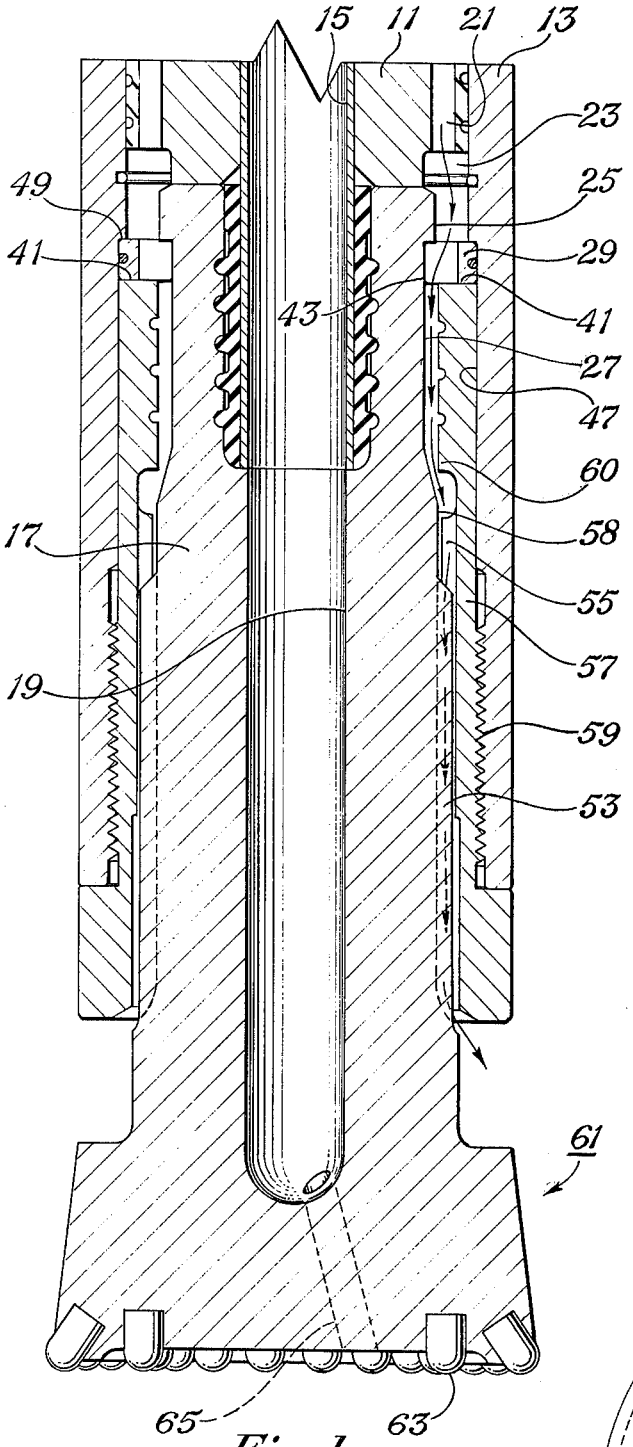
FIG. 1 is a view in longitudinal section of a fluid operated, percussion type drill motor and anvil bit retained therein by a split-type stop ring constructed in accordance with the principles of the invention.

Referring initially to FIG. 1, the numeral 11 designates a reciprocating piston-hammer that moves within a housing 13 and over a central valving tube 15 (see for example U.S. Pat. No. 3,714,993) secured to the upper portion of an anvil bit 17, the valving tube and bit having a central passageway 19 for the flow of fluid from the piston-hammer 11. The motor and piston-hammer arrangement preferably have in this instance the form disclosed in U.S. Pat. No. 3,595,323. In such apparatus the piston-hammer 11 has passages 21 that enable the flow of fluid, usually air, into a forward working chamber 23. If the fluid can be exhausted from this working chamber to atmospheric pressure, reciprocation of the piston-hammer can be ceased, as explained in the patent.

Figure 3:
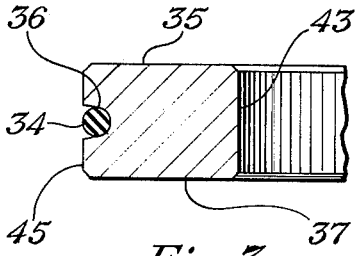
FIG. 3 is a cross-sectional view of the split type stop ring as seen looking along the lines III—III of FIG. 2.

A portion of the walls of the forward working chamber 23 are formed by an annular shoulder 25 of an upper portion of the anvil bit. This shoulder is adjacent an annular groove or recess 27 that receives the improved split-type stop ring 29, the preferred construction of which can best be seen in FIGS. 2 and 3. In this embodiment the ring has two separable body portions 31, 33 held with a flexible retainer 35 in a peripheral groove 36. Thus is formed an annular composite body with upper and lower surfaces 35, 37 (see FIG. 3) adapted to engage respectively the shoulder 25 on the bit and an upwardly facing shoulder 41 formed in the housing 13 as a part of a groove means adapted to retain the split-ring and anvil bit within the housing.

The interior annular surface 43 of the split-ring 29 circumscribes and slidingly enters the mating annular recess 27 of the bit. The exterior annular surface 45 of the composite body 29 extends outwardly into close proximity with an interior wall 47 of the housing. The lower surface 37 of the ring engages a shoulder 41 formed in the housing, as previously explained, and upper surface 35 engages another surface 49 in the housing which forms a part of the groove means to confine the ring in a selected position.

Figure 2:
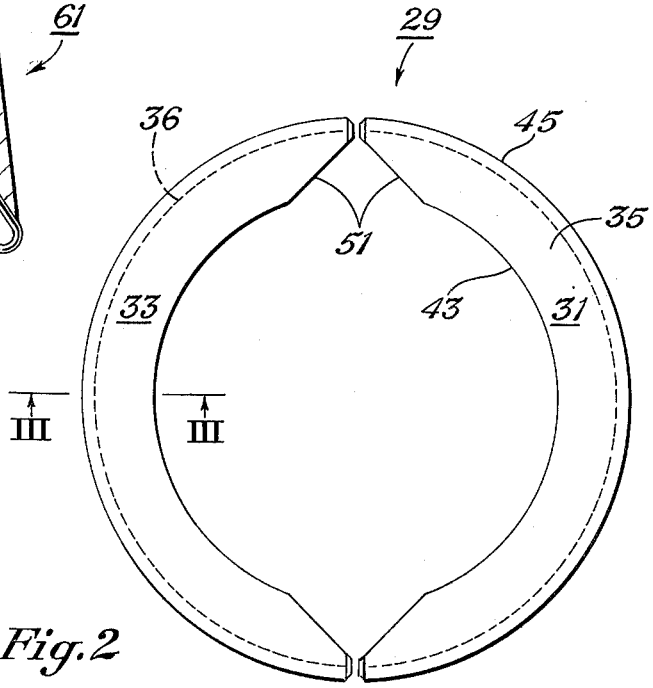
FIG. 2 is a top view, showing in better detail the preferred construction of the improved split-type stop ring.

The composite annular body has fluid passage means that here consists of a slot 51 formed obliquely across each end of each of the body portions 31, 33 as indicated in FIG. 2. This wedge-shaped slot means permits the flow of fluid from the forward working chamber 23 between the split-ring 29 and the upper shoulder 25 of the anvil bit and the annular area formed by recess 27 of the bit and cylindrical surface 60 of the driver sub.

A mid-region of the bit has splines 53 to engage the recesses of interior splines 55 formed on a driver sub 57 that is threaded at 59 to the housing 13. In this instance the driver sub 57 is also utilized for forming the previously described shoulder 25 that engages the lower surface 37 of the split ring 29.

As indicated by the arrows in FIG. 1, fluid may flow from the forward working chamber 23 past the split-ring 29, recess 27, splines 53, 55 and to the exterior of the bit and housing. This reduces fluid pressure in the forward working chamber 23 to a level preventing upward movement and hence reciprocation of the piston-hammer 11. When the bit is lowered against a borehole bottom, however, the cylindrical surface 58 of the bit and mating cylindrical surface 60 of the driver sub 57 assume sufficiently close proximity to cause pressure increase in the forward working chamber 23 to raise the piston-hammer 11 and initiate reciprocation.

The lower end 61 of the bit may have any one of a number of the satisfactory prior art configurations that includes suitable cutting structures 63 and passages 65. One suitable prior art configuration may be seen in FIGS. 1 – 3 of U.S. Pat. No. 3,185,228.

During assembly, the flexible retainer 34, preferably an O-ring, is removed from around the peripheral groove 36 in each of the separable body portions 31, 33 of the split-type stop ring 29. This enables the positioning of the body portions 31, 33 in the annular recess 27 in the upper region of the anvil bit 17. Also the splined driver sub 57 may be positioned around the bit such that its upper shoulder 41 is below the lower surface 37 of the split ring. Then the bit 17, split ring 29 and splined driver sub 57 may be inserted within the housing 13 and secured with threads 59. As thus assembled, the split ring 29, housing 13 and driver sub 57 cooperate to confine the bit within the housing to receive striking blows from piston-hammer 11. The configuration of the split ring 29 and recess 27 in the bit enables a selected amount of axial movement of the bit within the housing 13.

In operation and during drilling, pressurizing the fluid inside the housing 13 causes the piston-hammer 11 to reciprocate against the upper portion of the anvil bit 17. If the bit is suspended above the bottom of the borehole, the bit will descend relative to the housing and assume the position shown in FIG. 1. In this position, piston-hammer 11 reciprocation ceases if the pressure in forward working chamber 23 can be reduced sufficiently. The present invention accomplishes this reduction by permitting fluid flow through the passage or slot means 51 in the composite body of the split-type stop ring 29, through the annular recess 27 and past the splined means 53, 57 to the exterior of the bit. Lowering the bit against the borehole bottom pushes the cylindrical surface 58 of the anvil bit upward and opposite cylindrical surface 60 of the driver sub 57 to increase the pressure in forward working cavity 23. Thus, reciprocation of the piston-hammer 11 is initiated once again.

It should be apparent from the foregoing description that an invention of significant advantages has been provided. Utilization of the split-type stop ring constructed in accordance with the principles explained above enables the exhaust of fluid past the bit and the housing without necessity for the provision of additional passages that are not ordinarily present in these structures. While the invention has been shown in only one of its forms, it should be apparent to those skilled in the art that it is not so limited but is susceptible to various changes and modifications without departing from the spirit thereof. The passage or slot means described need not necessarily have the configuration shown in the preferred embodiment, but may include a variety of passage configurations that satisfy the requirement of enabling the flow of fluid past or through the split ring to by-pass fluid to the exterior of the bit.

I claim:

1. In a fluid operated, percussion type drill motor of the type enabling pressurizing fluid by-pass for piston-hammer cessation when the associated drill bit is suspended above a borehole bottom, the improvement which comprises:

a housing;

a drill bit having an upper, anvil surface adapted for percussive engagement with the piston-hammer, said bit having a smoothly cylindrical annular shoulder on its upper end, an adjoining annular recess, and splined means below the recess;

mating spline means carried by the housing to engage those of the drill bit to rotate the bit upon rotation of the housing;

a smoothly cylindrical annular groove means in the housing;

an improved split-type ring adapted to fit partially within the annular recess in the bit and partially within the annular groove means in the housing and having at least two body portions with abutting ends forming a composite body with upper and lower surfaces to engage respectively the shoulder on the exterior of the bit and the groove means in the housing to retain reciprocably the bit within the housing; and at least one of the body portions of the ring including slot means to increase the space between abutting ends of said body portions to permit the by-pass of the pressurizing fluid past the exterior of the bit, the ring, and the housing and cause piston-hammer cessation when the bit is raised from the borehole bottom and said shoulder on the bit is in engagement with said upper surface of the body sections.

* * * * *

UNITED STATES PATENT OFFICE

CERTIFICATE OF CORRECTION

Patent No. 3,986,565 Dated October 19, 1976

Inventor(s) Gerald O. Atkinson

It is certified that error appears in the above-identified patent and that said Letters Patent are hereby corrected as shown below:

Claim 1, column 4, lines 39 and 40, delete [including slot means to increase the space between abutting ends of said body portions] and insert --including wedge shaped slot means formed across the ends of one of the body portions to increase the space between abutting ends of said body portions--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*